US006054952A

United States Patent [19]

Shen et al.

[11] Patent Number: 6,054,952

[45] Date of Patent: Apr. 25, 2000

[54] BROAD-BAND MICROSTRIP ANTENNA

[75] Inventors: Min-Hung Shen, Hsinchu Hsien; Sheng-Ming Deng, Taipei; Tsung-Yang Hung, Ping-Tung Hsien, all of Taiwan

[73] Assignee: Industrial Technology Research Institute, Hsinchu, Taiwan

[21] Appl. No.: 09/191,932

[22] Filed: Nov. 13, 1998

[30] Foreign Application Priority Data

Jul. 10, 1998 [TW] Taiwan ..... 87111181

[51] Int. Cl.[7] ..... H01Q 1/38; H01Q 1/52

[52] U.S. Cl. ..... 343/700 MS; 343/702; 343/841; 343/846

[58] Field of Search ..... 343/700 MS, 702, 343/806, 913, 828, 841, 846

[56] References Cited

U.S. PATENT DOCUMENTS 4,138,681 2/1979 Davidson et al. ..... 343/702
4,356,492 10/1982 Kaloi ..... 343/700 MS
5,406,295 4/1995 Baranski et al. ..... 343/713
5,416,490 5/1995 Popovic ..... 343/700 MS

*Primary Examiner*—Tan Ho
*Attorney, Agent, or Firm*—Jiawei Huang; J.C. Patents

[57] ABSTRACT

A broad-band microstrip antenna implemented using a dielectric base as its main body is disclosed. The base has two sides where the dual-mode resonator is located on the first side, while the grounded plane is located on the second side of the dielectric base. The dual-mode resonator has a high-frequency resonator and a low-frequency resonator, which are partially positioned in parallel. Due to the electric-magnetic effects, these two resonators are mutually coupled to significantly increase the operating bandwidth. In addition, there is a feed line on the first side of the dielectric base, which connects to the dual-mode resonator to provide signal transmission. In addition, there is a grounded mask in the antenna, which is located on the first side of the dielectric base, to provide sheltering for the feed line, and connect to the grounded plane to form a closed area to provide a more complete radiation field pattern.

23 Claims, 9 Drawing Sheets

BROAD-BAND MICROSTRIP ANTENNA

CROSS-REFERENCE TO RELATED APPLICATION

This application claims priority benefit of Taiwan application serial no. 87111181, filed Jul. 10, 1998, the full disclosure of which is incorporated herein by reference.

BACKGROUND OF THE INVENTION

1. Field of Invention

The present invention relates to a microwave antenna. More particularly, the present invention relates to a microstrip antenna which uses a dual-mode resonator to increase an operating bandwidth.

2. Description of Related Art

Telecommunication technologies have made dramatic progress owing to rapid technology advancement. There are also immense commercial opportunities for telecommunication providers. In wireless mobile telecommunication systems, the transmission and receiving of signals dominate the communication quality. It is, therefore, the primary objective to pursuit an antenna having a broad band and a high isotropic radiation field pattern. That is, increasing the operating bandwidth and making the radiation field pattern evenly distributed become the primary objective for designing an antenna.

Refer to FIG. 1, which shows a conventional portable antenna of a mobile phone. The mobile phone 14 includes a line antenna 10 and a spiral antenna 12. When the phone set is not in use, the line antenna 10 can be invaginated in the mobile phone 14. The spiral antenna 12 which has inferior radiation efficiency is responsible for receiving microwave signals at this time. When the phone set is in use, the line antenna 10 can then be pulled out to transmit or receive microwave signals with better radiation efficiency. This kind of portable mobile phone antenna is inconvenient to use though it improves the carrying problem of traditional line antennas.

Refer to FIG. 2, which shows another conventional portable mobile phone antenna. As shown in this figure, L-shape antenna 20 is constructed on the circuit board 22, which is positioned in the mobile phone case 24. This kind of built-in antenna will not affect the portability and operation of the users. It depends, however, on manual assembly, which will reduce the reliability for antenna duplication. Further more, though the antenna is directly grounded to reduce size, it also reduces the gain of the antenna.

Refer to FIG. 3, which shows a conventional toploaded antenna. The toploaded antenna is normally constructed on a case of a telecommunication transceiver. This will cause portability problems for personal mobile telecommunication equipment. In addition, the toploaded antenna which depends on manual assembly has disadvantages of poor reliability for duplication and high personnel costs during a manufacturing process of the telecommunication equipment.

Refer to FIG. 4, which shows a butterfly-shape plane antenna 41, which can be produced by using a printed circuit board. The butterfly-shape plane antenna 41 includes a butterfly-shape microstrip line 42 and a balun feed-in strip transmission line 44. The butterfly-shape microstrip line 42 and a balun feed-in strip transmission line 44 are built on both sides of the printed circuit board 40, respectively. For the butterfly-shape plane antenna 41 operating at center frequency of, for example, 1.7 GHz, the length of the rectangular loop of the balun feed-in strip transmission line 44 is about 1.7 cm. Taking into account of the balun feed-in strip transmission line 44, the size of the butterfly-shape plane antenna 41 is too large for a small-scale telecommunication transceiver.

Refer to FIG. 5, which shows a conventional dual-L plane antenna 50. As shown in the figure, the dual-L plane antenna 50 includes a grounded plane 52, a high-frequency resonator 54, and a low-frequency resonator 56, where the high-frequency resonator 54 and low-frequency resonator 56 are connected to the grounded plane 52 respectively. By changing the interval between these two resonators, the bandwidth of the antenna 50 can be adjusted. In practical application, however, the size of this antenna is still too big for mobile telecommunication equipment. Further more, there is a need of accurate metal working during the manufacturing process. Also, manual assembly produces larger error, which provides less accuracy during operations. Because the strength of the structure needs to be enhanced by copperizing the alloy to avoid shift and shaking, the manufacturing cost also increases due to the additional processes incurred.

Refer to FIG. 6, which shows a patch antenna. As shown in the figure, base board 60 includes patch resonators 62, 64, 66 on the same plane. The center frequency of the antenna is about 2.4 GHz. As shown in FIG. 7, the relative bandwidth of the antenna is about 1%.

As a summary from previous discussions, there are at least several defects for the microwave antenna structures mentioned:

1. Narrow operating bandwidth;
2. Inconvenient to use because of the large size of the antenna; and
3. Poor reliability and high personnel cost because of the manual assembly required.

In light of the foregoing, there is a need to provide a broad-band microstrip antenna for mobile telecommunication equipment.

SUMMARY OF THE INVENTION

Accordingly, the present invention is to provide a broad-band microstrip antenna to increase the operating bandwidth of the antenna, so that the transmitting and receiving qualities can be enhanced. Furthermore, the broad-band microstrip antenna can be implemented using generally available printed circuit boards to reduce size to make it more applicable. Also, the implementation of the broad-band microstrip antenna does not depend on manual assembly, so that the reliability can be increased and costs can be reduced.

To achieve these and other advantages and in accordance with the purpose of the invention, as embodied and broadly described herein, the invention provides a broad-band microstrip antenna of which the structure is described as follows:

The main body of the antenna is implemented via a dielectric base which has a plane structure of two sides. The dual-mode resonator locates on the first side of the dielectric base. It can be a wine-glass-like structure, including a high-frequency resonator and a low-frequency resonator. These two resonators are partially positioned in parallel. Due to the electric-magnetic effects, these two resonators are mutually coupled to significantly increase the operating bandwidth. In addition, there is a feed line on the first side of the dielectric base, which connects to the dual-mode resonator to provide signal transmission.

On the second side of the dielectric base, a grounded plane is placed opposite to the feed line on the first side to provide grounding. In addition, the antenna has a grounded mask which is located on the first side of the dielectric base to provide sheltering for the feed line. It is also connected to the grounded plane to form a closed grounded area to provide a more complete radiation field pattern.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 2:
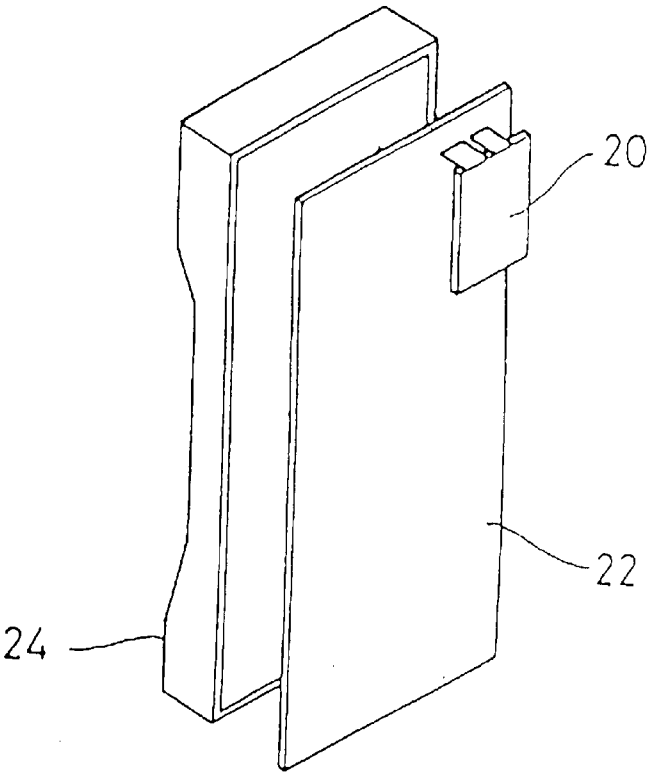
FIG. 2 (PRIOR ART)
FIG. 2 is another conventional portable mobile phone antenna.
Figure 1:
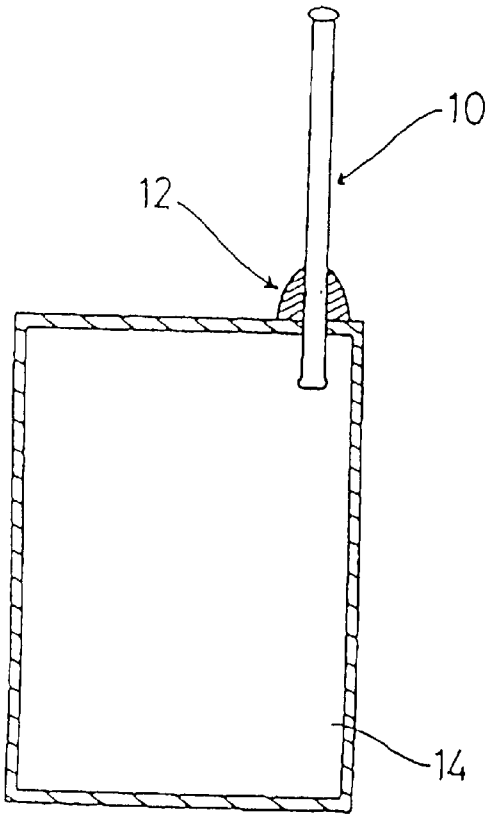
FIG. 1 (PRIOR ART)
FIG. 1 is a conventional portable mobile phone antenna.
Figure 3:
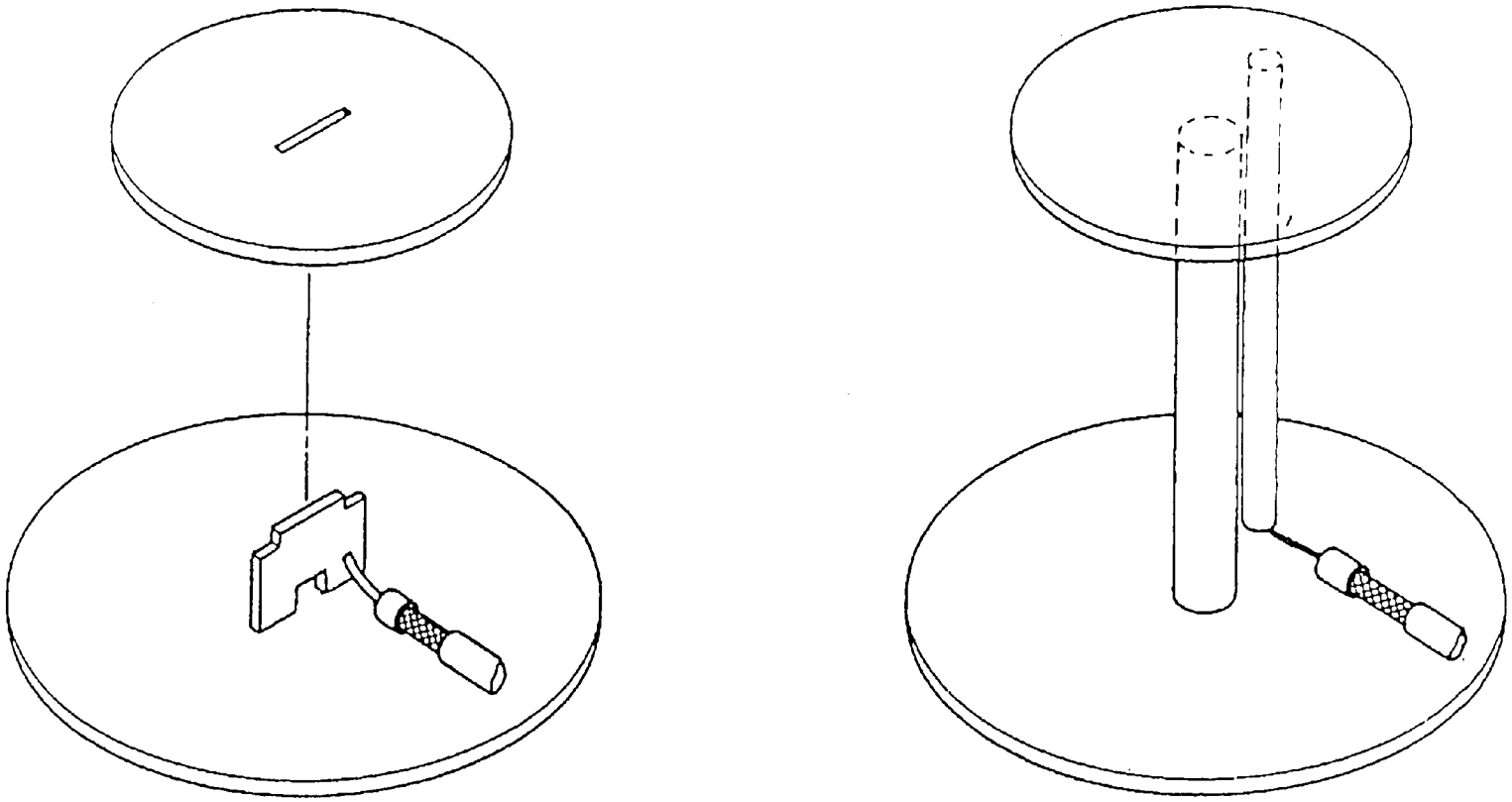
FIG. 3 (PRIOR ART)
FIG. 3 is a conventional toploaded antenna.
Figure 4:
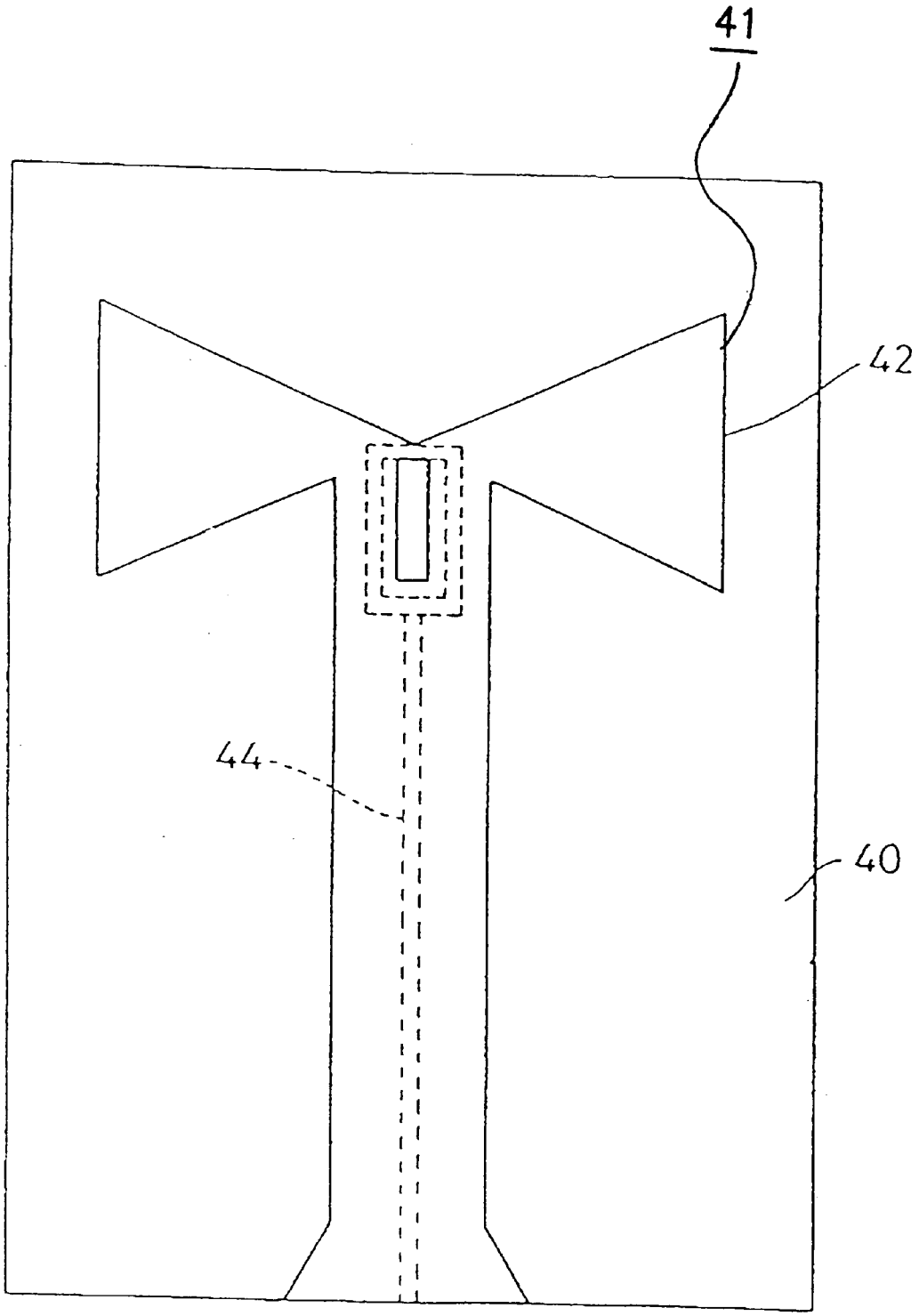
FIG. 4 (PRIOR ART)
FIG. 4 is a conventional butterfly-shape plane antenna.
Figure 5:
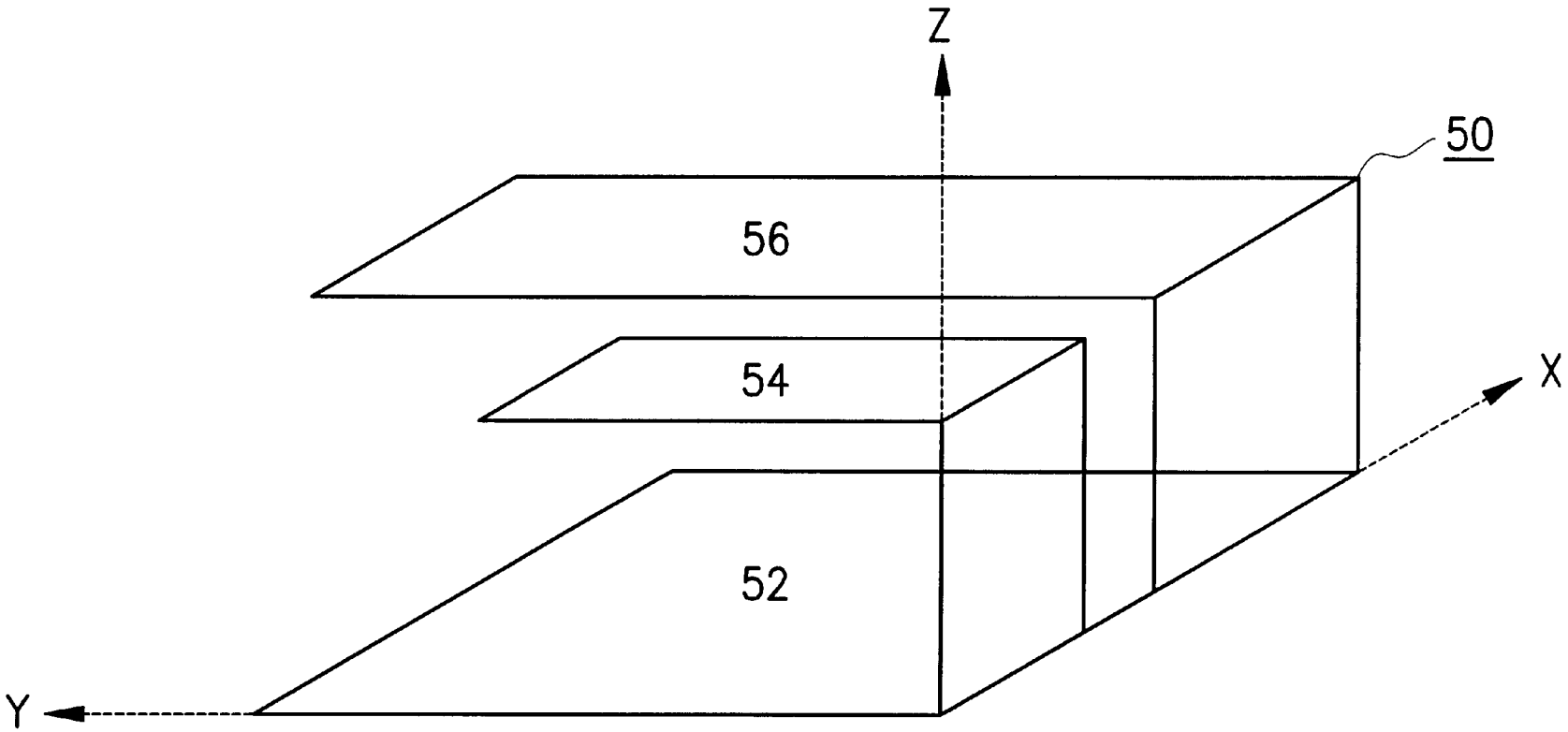
FIG. 5 (PRIOR ART)
FIG. 5 is a conventional dual-L plane antenna.
Figure 6:
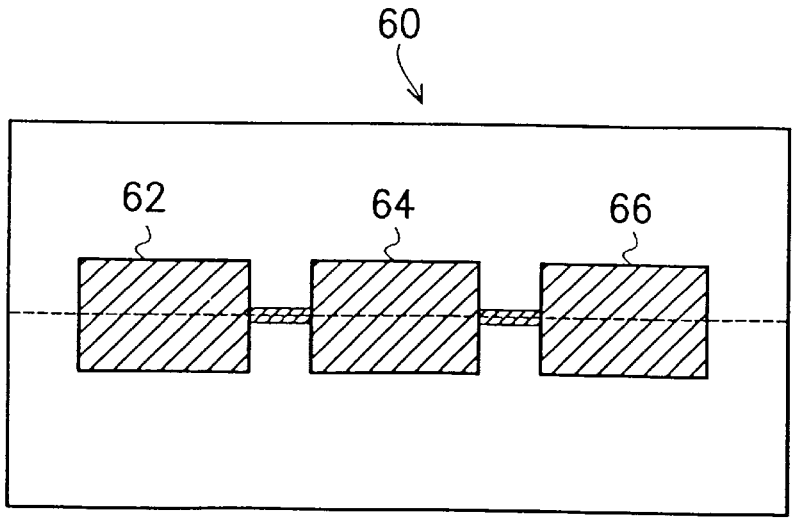
FIG. 6 (PRIOR ART)
FIG. 6 is a conventional patch antenna.
Figure 7:
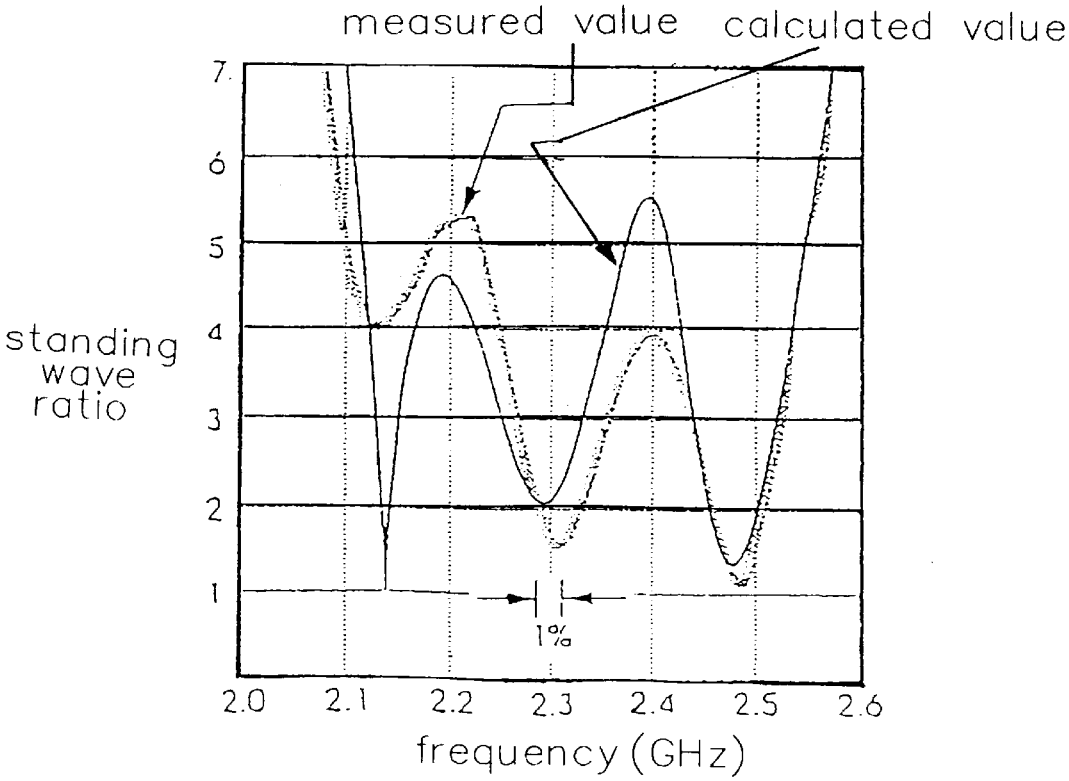
FIG. 7 (PRIOR ART)
FIG. 7 is a diagram showing the relative bandwidth of the patch antenna of FIG. 6.

Reference will now be made in detail to the present preferred embodiments of the invention, examples of which are illustrated in the accompanying drawings. Wherever possible, the same reference numbers are used in the drawings and the description to refer to the same or like parts.

Figure 8A:
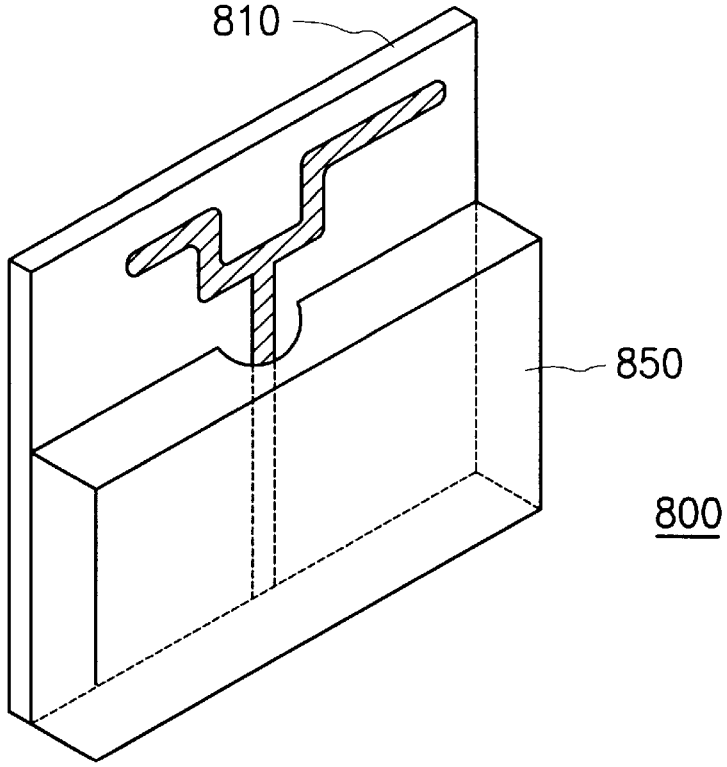
FIGS. 8A to 8D are diagrams showing the broad-band microstrip antenna as a preferred embodiment of this invention.

Refer now to FIG. 8A, which shows a preferred embodiment of the present invention. The broad-band microstrip antenna 800 includes a dielectric base 810 and a grounded mask 850. The dielectric base 810 can be made from, for example, glass fiber, Teflon, or ceramics. The dielectric constant of the dielectric base 810 depends on the material used to implement the dielectric base 810. For example, the dielectric constant lies between 4.0 and 4.7 for glass fiber, where 4.3 is acceptable as the calculation base in general. The main body of the antenna 800 is located on the dielectric base 810. These two parts will be illustrated in details hereinafter.

Figure 8B:
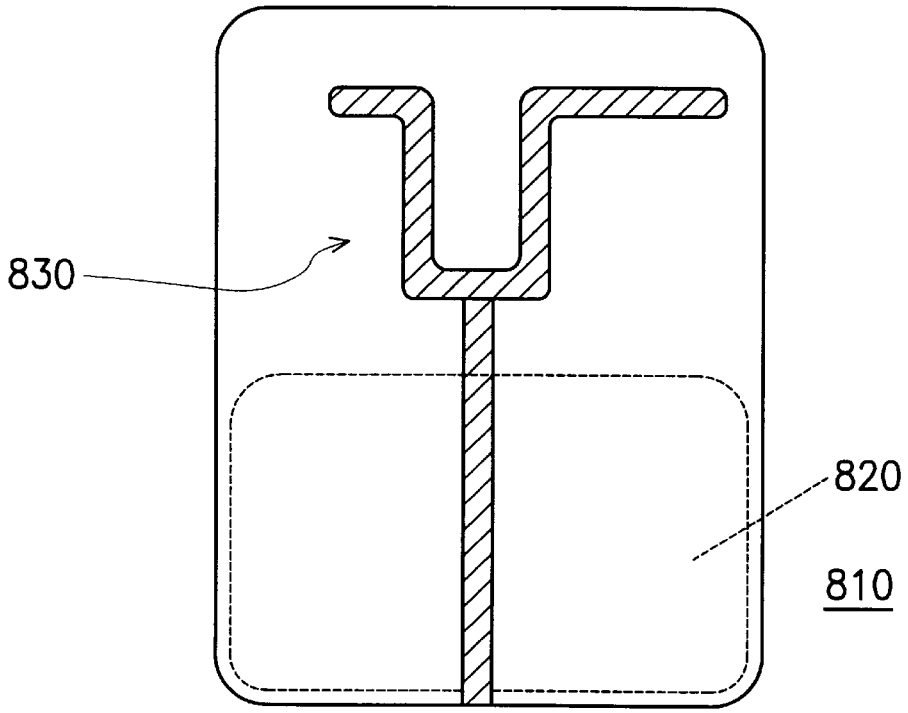

Refer to FIG. 8B, which shows the main body of the antenna 800 on the dielectric base 810. It is well known that there are two sides for the dielectric base 810. As shown in the figure, microstrip line 830 is located on the first side, while the grounded plane 820 is located on the second side. The microstrip line 830 and the grounded plane 820 are located on opposite sides of the dielectric base 810, where the grounded plane 820 is represented by dotted lines for easy distinction.

Figure 8C:
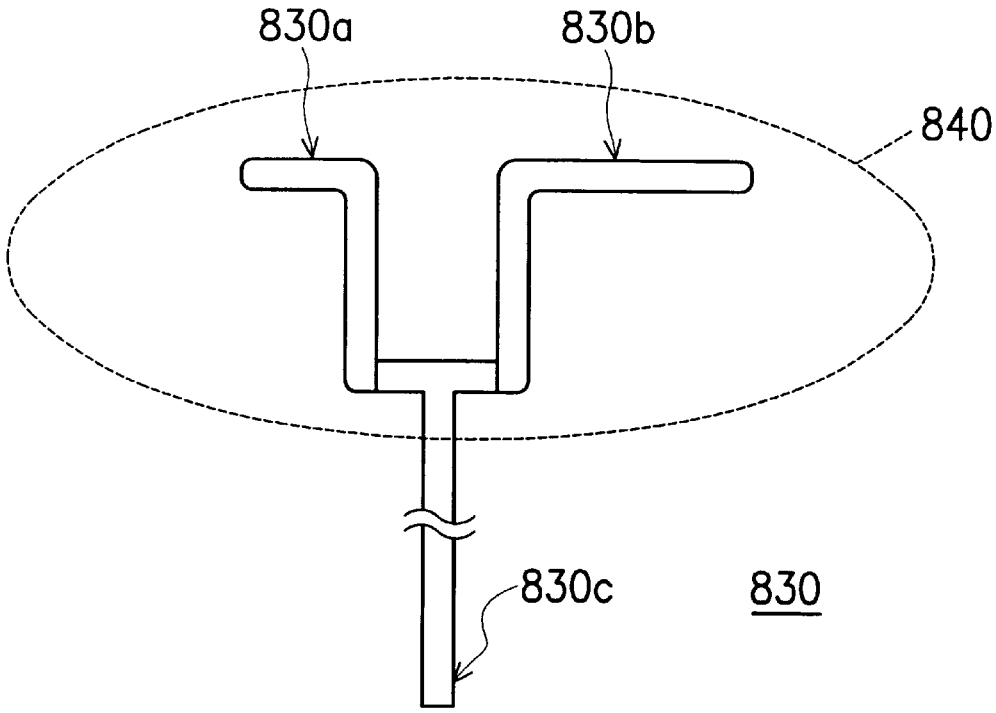

Refer to FIG. 8C, which shows the detailed components of the microstrip line in FIG. 8B. As shown in the figure, the microstrip line 830 includes a feed line 830*c* and a dual-mode resonator 840. The dual-mode resonator 840 includes a high-frequency resonator 830*a* and a low-frequency resonator 830*b*, and is connected to feed line 830*c*. Because high-frequency resonator 830*a* and low-frequency 830*b* are closely positioned and are partially in parallel, a pair of non-grounded coupled line is formed therewith. When signals are transmitted over the coupled line, the coupling effect will integrate both the high- and low-frequency effects to increase the operating bandwidth. Note that the grounded plane 820 (of FIG. 8B) is positioned opposite to the feed line 830*c*. Therefore, there is no grounded plane on the first side of the dual-mode resonator 840. The antenna works properly in this way.

Figure 8D:
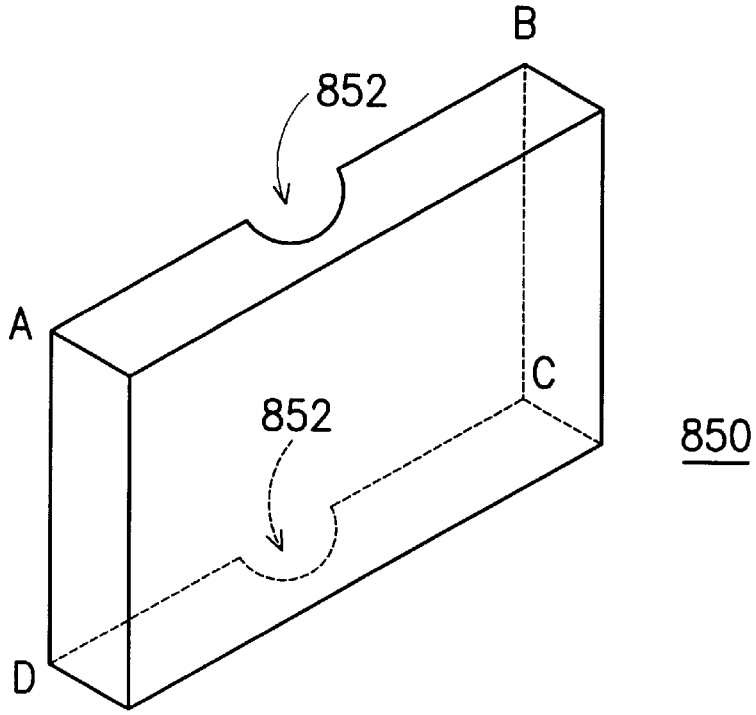

Refer to FIG. 8D, which shows the structure of a grounded mask 850. The grounded mask 850 is primarily used to shelter feed line 830*c*, and coupled to the grounded plane 820 to form a complete closed grounded area. For example, the grounded mask 850, as shown in the figure, can be a cubic hollow structure. All sides of the grounded mask 850 are made of metal material, except surface ABCD. When the grounded mask 850 and the dielectric base 810 are put together as shown in FIG. 8A, the grounded mask 850 and the grounded plane 820 can be connected each other via proper connections. A closed grounded area can therefore be formed in this way. Note that the grounded mask 850 has a breach 852 on its rim, which is close to the feed line 830*c*. When the grounded mask 850 is sued to shelter the feed line 830*c*, there is no contact between the grounded mask 850 and the feed line 830*c*, and therefore the transmission of signals over the feed line 830*c* are not affected. Of course, the shape of the grounded mask is not limited to the cubic hollow structure. Structures achieving the similar functions should also fall within the scope of the invention.

Figure 9:
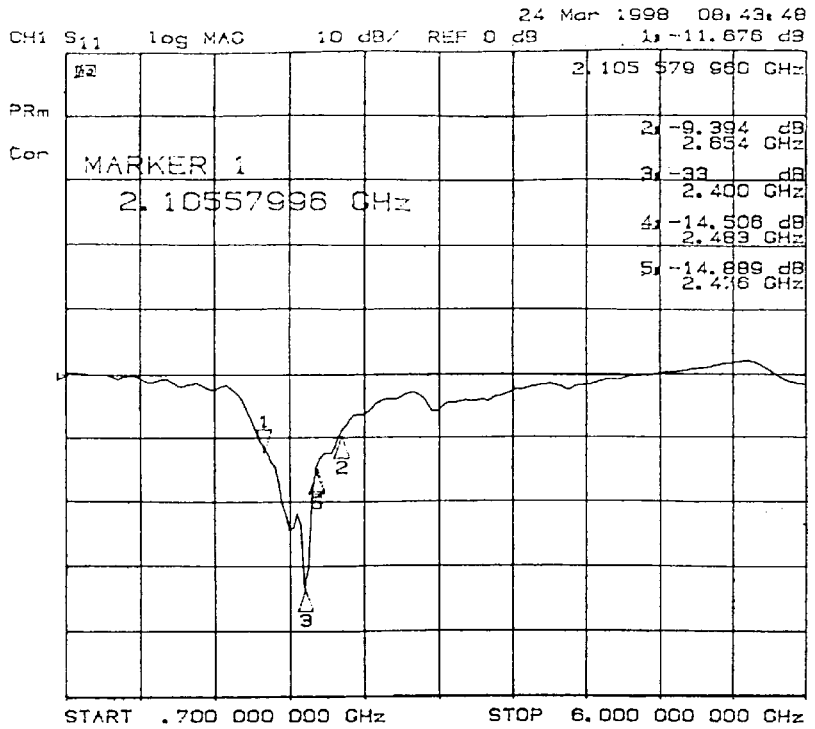
FIG. 9 is a diagram showing the reflection ratio measured from the broad-band microstrip antenna as shown in FIG. 8A.

Refer to FIG. 9, which shows the reflection ratio measured from the broad-band microstrip antenna as shown in FIG. 8A. Generally speaking, the relative bandwidth for this kind of antenna is greater than 20%. As shown in the figure, the broad-band microstrip antenna 800 has a center frequency of 2.4 GHz, and a bandwidth of 570 MHz. Accordingly, the relative bandwidth is about 24%.

Figure 10:
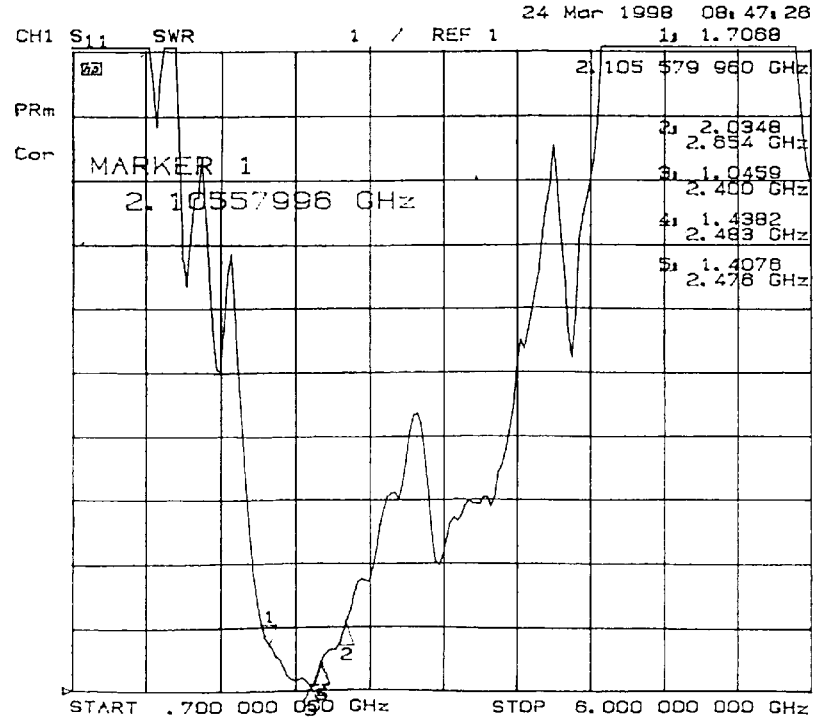
FIG. 10 is a diagram showing the standing wave ratio measured from the broad-band microstrip antenna as shown in FIG. 8A.

Refer to FIG. 10, which shows the standing wave ratio (SWR) measured from the broad-band microstrip antenna according to FIG. 8A. As shown in this figure, the standing wave ratio at center frequency is about 1.0459, and the operating bandwidth is about 600 MHz. The SWR is lower than 1.5 for frequency ranged between 2.4 GHz and 2.483 GHz.

Figure 11:
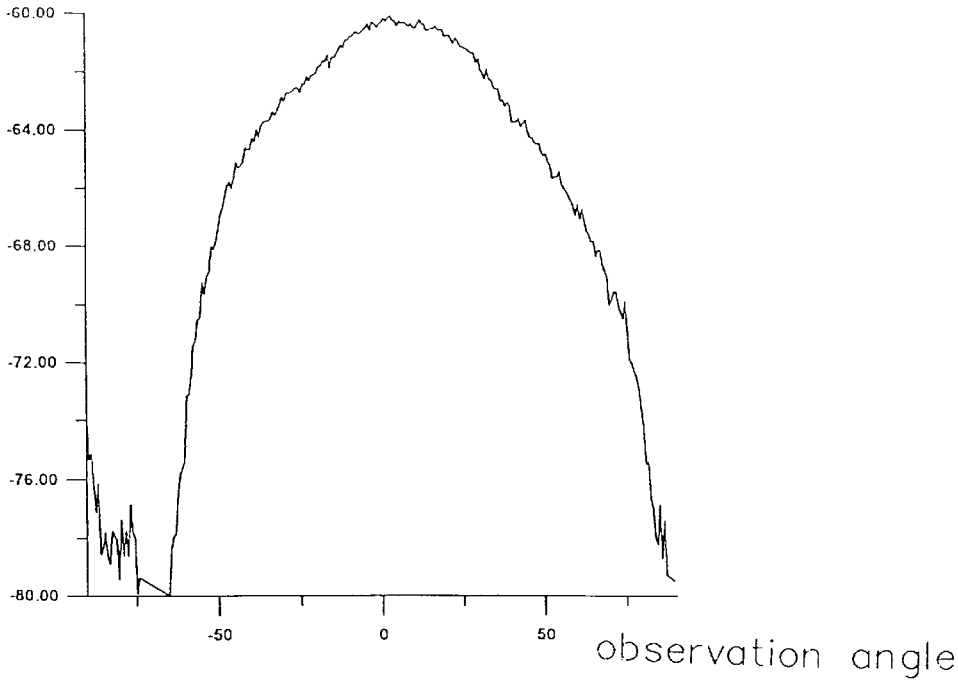
FIG. 11 is a diagram showing the H-plane field pattern measured from the broad-band microstrip antenna as shown in FIG. 8A.

Refer to FIG. 11, which shows the H-plane field pattern measured from the broad-band microstrip antenna according to FIG. 8A. As shown in this figure, the −3 dB bandwidth is about 60 degrees.

Figure 12:
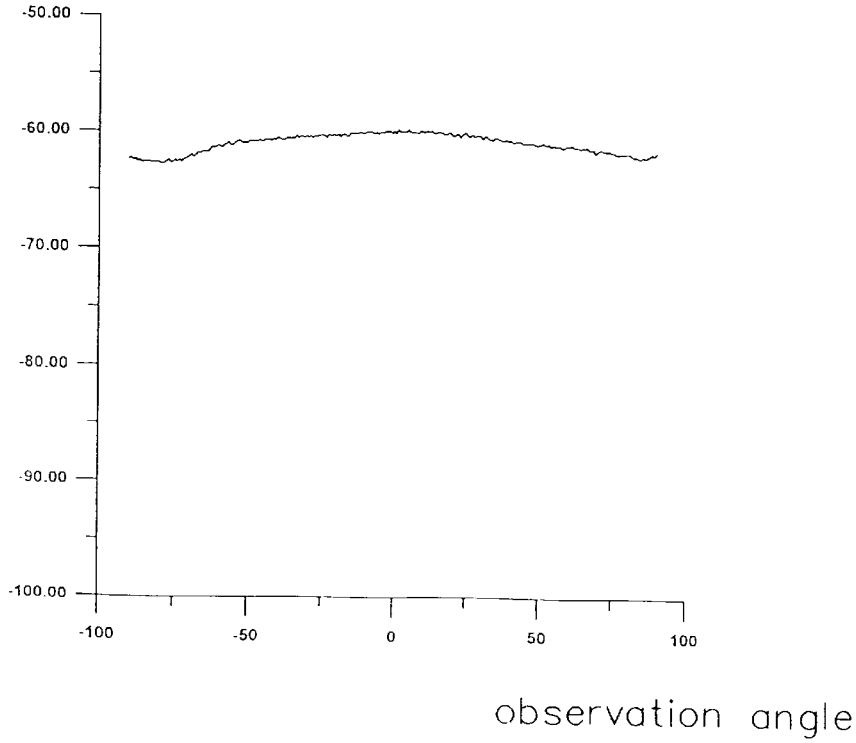
FIG. 12 is a diagram showing the E-plane field pattern measured from the broad-band microstrip antenna as shown in FIG. 8A.

Refer to FIG. 12, which shows the E-plane field pattern measured from the broad-band microstrip antenna according to FIG. 8A. It shows good isotropic scattering.

In view of the foregoing, the broad-band microstrip antenna of the present invention has at least these advantages:

1. It can be implemented using a circuit board, which is cheap, compact, reliable for duplication, and robust in structure.
2. It has a broad operating bandwidth and high radiation efficiency.

3. It has a evenly distributed E-plane field pattern and good isotropic scattering. The quality for transmitting and receiving signals is also good.

Note that the broad-band microstrip antenna in the present invention has a center frequency adjustable according to the size of the dual-mode resonator 840. More precisely, the center frequency is closely related to the size and coupling effects of the high-frequency resonator and low-frequency resonator. That is, the size and relative position of the high-frequency and low-frequency resonators can be adjusted to obtain the desired center frequency. It is one of the most characteristic techniques of this invention to obtain the center frequency by adjusting the size of the dual-mode resonator.

Previous description is provided only to describe the preferred embodiment. It is not, however, used to limit the invention. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A broad-band microstrip antenna, comprising:

a dielectric base having a first side and second side, wherein the first side and the second side are opposite to each other;

a dual-mode resonator, located on the first side, wherein the dual-mode resonator comprises a high-frequency resonator and a low-frequency resonator mutually coupled together, and each of the high-frequency resonator and the low-frequency resonator has a line-like structure with at least two right-angle bent structures so that the dual-mode resonator comprises a parallel partial portion between the high-frequency resonator and the low-frequency resonator;

a feed line, located on the first side, wherein the feed line is coupled to the dual-mode resonator; and a grounded plane, located on the second side, wherein the grounded plane is opposite to the feed line.

2. The broad-band microstrip antenna of claim 1, further comprising a grounded mask, which is located on the first side, for sheltering the feed line, wherein the grounded mask is coupled to the grounded plane to form a closed grounded area.

3. The broad-band microstrip antenna of claim 1, wherein a relative bandwidth of the broad-band microstrip antenna is greater than 20%.

4. The broad-band microstrip antenna of claim 3, wherein a relative bandwidth of the broad-band microstrip antenna is about 24%.

5. The broad-band microstrip antenna of claim 1, wherein a center frequency of the broad-band microstrip antenna is adjustable by varying the size of the dual-mode resonator.

6. The broad-band microstrip antenna of claim 5, wherein a center frequency of the broad-band microstrip antenna is about 2.4 GHz.

7. The broad-band microstrip antenna of claim 1, wherein a dielectric constant of the dielectric base depends on the composed material of the dielectric base used.

8. The broad-band microstrip antenna of claim 1, wherein the material for the dielectric base is made of glass fiber.

9. The broad-band microstrip antenna of claim 8, wherein the dielectric constant of the dielectric base is between 4.0 and 4.7.

10. The broad-band microstrip antenna of claim 9, wherein the dielectric constant of the dielectric base is about 4.3.

11. The broad-band microstrip antenna of claim 1, wherein the dielectric base is made of polytetrafluoroethene.

12. The broad-band microstrip antenna of claim 1, wherein the dielectric base is made of ceramics.

13. A broad-band microstrip antenna, comprising:

a dielectric base having a first side and second side, wherein the first side and the second side are opposite to each other;

a dual-mode resonator, located on the first side, wherein dual-mode resonator comprises a high-frequency resonator and a low-frequency resonator, wherein the high-frequency resonator and low-frequency resonator are mutually coupled;

a feed line, located on the first side, wherein the feed line is coupled to the dual-mode resonator;

a grounded plane, located on the second side, wherein the grounded plane is opposite to the feed line; and a grounded mask located on the first side, wherein the grounded mask is used to shelter the feed line and couples to the grounded plane to form a closed grounded area.

14. The broad-band microstrip antenna of claim 13 wherein a relative bandwidth of the broad-band microstrip antenna is greater than 20%.

15. The broad-band microstrip antenna of claim 14, wherein a relative bandwidth of the broad-band microstrip antenna is about 24%.

16. The broad-band microstrip antenna of claim 13, wherein a center frequency of the broad-band microstrip antenna is adjustable by varying the size of the dual-mode resonator.

17. The broad-band microstrip antenna of claim 13, wherein a center frequency of the broad-band microstrip antenna is about 2.4 GHz.

18. The broad-band microstrip antenna of claim 13, wherein a dielectric constant of the dielectric base depends on the composed material of the dielectric base used.

19. The broad-band microstrip antenna of claim 13, wherein the material for the dielectric base is made of glass fiber.

20. The broad-band microstrip antenna of claim 19, wherein the dielectric constant of the dielectric base is between 4.0 and 4.7.

21. The broad-band microstrip antenna of claim 20, wherein the dielectric constant of the dielectric base is about 4.3.

22. The broad-band microstrip antenna of claim 13, wherein the dielectric base is made of polytetrafluoroethene.

23. The broad-band microstrip antenna of claim 13, wherein the dielectric base is made of ceramics.

* * * * *